United States Patent [19]

Lovell

[11] 4,307,471

[45] Dec. 29, 1981

[54] PROTECTIVE HELMET

[75] Inventor: Peter J. Lovell, Kingston, Canada

[73] Assignee: Du Pont Canada Inc., Montreal, Canada

[21] Appl. No.: 920,554

[22] Filed: Jun. 29, 1978

Related U.S. Application Data

[63] Continuation-in-part of Ser. No. 862,380, Dec. 20, 1977, abandoned.

[30] Foreign Application Priority Data

Dec. 20, 1976 [GB] United Kingdom ..... 53178/76

[51] Int. Cl.[3] ..... A42B 3/00

[52] U.S. Cl. ..... 2/411; 2/425

[58] Field of Search ..... 2/6, 410, 411, 412, 2/413, 414, 416, 421, 422, 425, 205

[56] References Cited

U.S. PATENT DOCUMENTS

| | | | |
|---|---|---|---|
| 557,864 | 4/1896 | McNamara et al. | 2/422 |
| 1,104,808 | 7/1914 | Kockrolo | 2/411 |
| 3,413,656 | 12/1968 | Vogliano et al. | 2/412 |
| 3,529,306 | 9/1970 | Thorne | 2/411 |
| 3,594,814 | 7/1971 | Schuessler | 2/410 |

FOREIGN PATENT DOCUMENTS

| | | | |
|---|---|---|---|
| 693175 | 8/1964 | Canada . | |
| 1015503 | 8/1977 | Canada . | |
| 2504849 | 2/1975 | Fed. Rep. of Germany . | |
| 2614892 | 10/1977 | Fed. Rep. of Germany | 2/411 |
| 704725 | 5/1931 | France . | |
| 2335168 | 7/1977 | France | 2/411 |

*Primary Examiner*—Louis Rimrodt

[57] ABSTRACT

A helmet for the protection of sportsmen and/or workers in potentially hazardous occupations is disclosed. In one embodiment the helmet comprises a protective head shell and means to position the helmet on a users head in which the head shell has an outer section slidably connected to an inner section. The outer section is adapted to move relative to the inner section on impact with an object. In another embodiment the helmet further comprises a plurality of cushioning projections located between the two shells, each projection being integrally connected to one of the shells.

8 Claims, 10 Drawing Figures

PROTECTIVE HELMET

CROSS-REFERENCE TO RELATED APPLICATION

This is a continuation-in-part of copending application Ser. No. 862,380, filed Dec. 20, 1977, now abandoned.

BACKGROUND OF THE INVENTION

Helmets having a rigid or substantially rigid outer shell are used by sportsmen and workers involved in activities in which there is a risk of injury to the head.

The shape and design of protective helmets vary according to their intended use. In general, however, conventional protective helmets have a rigid or substantially rigid outer shell, cushioning means, such as foam padding and/or straps, and frequently a chin strap or similar device, to attach the helmet to the user's head. In such helmets the cushioning absorbs a major amount of the energy on impact with an object. While conventional protective helmets afford significant protection for the head of the user, such helmets are capable of improvement especially with respect to the amount of energy that may be absorbed by the shell of the helmet.

Protective helmets having two shells are known. For example, a protective helmet having interconnected internal and external shells is disclosed in U.S. Pat. No. 3,413,656 to G. Vogliano and D. Beckman, issued Dec. 3, 1968. A helmet having two shells and adapted for circulation of air between the shells for cooling is disclosed in Canadian Pat. No. 693,175 of R. F. Denton, issued Aug. 25, 1964.

SUMMARY OF THE INVENTION

The present invention provides a protective helmet having two shells adapted for the improved absorption of energy on impact with an object.

Specifically, the present invention provides a protective helmet comprising a head shell of thermoplastic material and support means adapted to position said helmet on a users head, said head shell having an inner section and an outer section, said outer section being superimposed on part of said inner section and being slidably connected to the inner section at at least two locations juxtaposed to the edge of the outer section, the outer section being spaced apart from the inner section away from said locations, said outer section being adapted to move relative to the inner section on impact of an object with said outer shell.

In a preferred embodiment, the present invention also provides a plurality of projections located between the inner shell and the outer shell, each of said projections being integrally connected to a base selected from the group consisting of (i) the outer shell, (ii) the inner shell, and (iii) a base independent of said shells and which is located between said shells, said projections being elongated and substantially rigid and being adapted to flex when subjected to compressive force, the projections having free ends that contact or are juxtaposed to a shell.

The present invention also provides a protective helmet comprising:

(a) an outer shell;

(b) cushioning means located on the inside of said outer shell, said cushioning means including an inner shell spaced apart from the outer shell and being adapted to move relative to the outer shell;

(c) a plurality of projections located between the inner shell and the outer shell, each of said projections being integrally connected to a base selected from the group consisting of (i) the outer shell, (ii) the inner shell, and (iii) a base independent of said shells and which is located between said shells, said projections being elongated and substantially rigid and being adapted to flex when subjected to compressive force, the projections having free ends that contact or are juxtaposed to a shell; and (d) support means adapted to position said helmet on a users head.

DETAILED DESCRIPTION OF THE INVENTION

Figure 1:
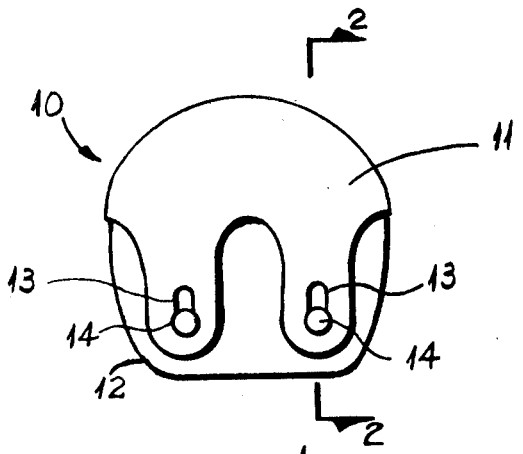
FIG. 1 is a schematic representation of a protective helmet having two shells when viewed from the rear.

With reference to the drawings, FIG. 1 shows a protective helmet, generally indicated by 10, having an outer shell 11 and an inner shell 12. Outer shell 11 is superimposed on inner shell 12 and partially covers inner shell 12. As shown in the drawing outer shell 11 has two elongated orifices 13 near the outer edge of the shell. Pins 14 that are attached (not shown) to inner shell 12 project through elongated orifices 13 and slidably attach outer shell 11 to inner shell 12.

Figure 2:
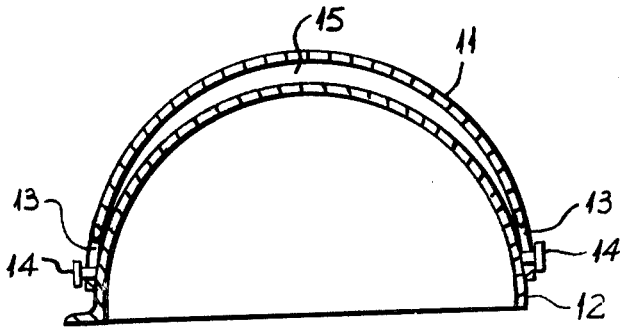
FIG. 2 is a schematic representation of a cross-section of the helmet of FIG. 1 along the line 2—2.

The protective helmet of FIG. 1 is shown in cross-section in FIG. 2. Outer shell 11 is superimposed on inner shell 12, being slidably attached to inner shell 12 by means of pins 14 through elongated orifices 13. Away from pins 14, outer shell 11 is spaced apart from inner shell 12, forming space 15 therebetween.

When outer shell 11 is struck by an object, outer shell 11 is forced towards inner shell 12. Air in space 15 acts as a cushion to absorb part of the energy of impact. In addition outer shell 11 moves relative to inner shell 12, such movement being facilitated by pins 14 in elongated orifices 13, thereby absorbing an additional part of the energy of impact. Subsequently outer shell 11 will return to its original position.

Although not shown in FIG. 1 or FIG. 2, the protective helmet can have additional cushioning means e.g. foam pads and/or elastic straps located within the helmet for further absorption of energy. The helmet will normally also have support means, e.g. straps, adapted to position the helmet on a users head. The helmet may also have attachment means, e.g. a chin strap, adapted to retain the helmet on the users head.

While not shown in FIGS. 1 and 2, one or both of outer shell 11 and inner shell 12 can have projections integrally attached thereto. Alternatively projections on a separate base can be placed in space 15. The use of projections in the embodiment of FIG. 1 and FIG. 2 must be selective so as not to significantly hinder the relative movement of outer shell 11 with respect to inner shell 12 on impact of an object with outer shell 11.

Such projections are often elongated and taper towards their free end, and are adapted to flex when subjected to a compressive force and revert to substantially their original shape when relieved of the effects of such a force. Such projections are referred to herein as being substantially rigid.

Figure 3:
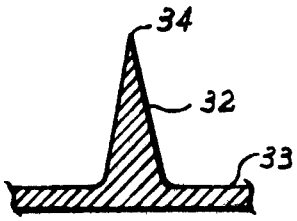
FIG. 3 and FIG. 4 are schematic representations of embodiments of projections in cross-section which can be used in the present invention.
Figure 4:
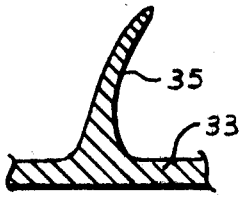

Examples of such projections are shown in FIG. 3 and FIG. 4. In FIG. 3 the projection 32 is essentially at right angles to the base 33 of the projection, base 33 being part of inner shell 12 or outer shell 11 of FIG. 1 or base 33 may be a separate base located in space 15 between outer shell 11 and inner shell 12 of FIG. 2. Projection 32 is upright and tapers towards projection end 34. In contrast projection 35 of FIG. 4 is not at right angles to base 33 and in the embodiment shown projection 35 is curved. In cross-section projections 32 and 35 can be circular, square or another convenient shape, including elongated rectangular.

Figure 5:
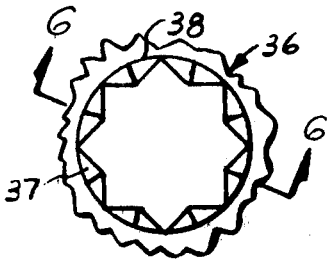
FIG. 5 is a schematic representation of a plan view of an embodiment of the projections.
Figure 6:
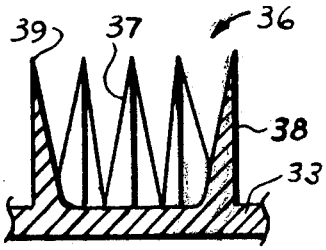
FIG. 6 is a schematic representation of a cross-section of the projections of FIG. 5.

A preferred example of a projection is shown in FIG. 5 and FIG. 6. The projection, generally indicated by 36, is comprised of a plurality of protrusions 37, eight in the embodiment shown, arranged in a circle, the outside sections 38 of protrusions 37 being on the circumference of the circle. Projection 36 is shown in cross-section in FIG. 6 to be cylindrical with outside section 38 thereof forming the edge of the cylinder. Protrusions 37 taper towards protrusion end 39. Projection 36 resembles a crown in general shape.

In one embodiment of the invention, such projections are integrally attached to the inner shell. Alternatively, some or all of the projections can be attached to the outer shell or each of the outer shell and the inner shell can have projections attached thereto. In still another embodiment both the inner shell and the outer shell can be free of projections. In such an embodiment projections are positioned on a separate base and the base with its projections is located between the inner shell and the outer shell. Such projections can be on one or both sides of the base.

Figure 7:
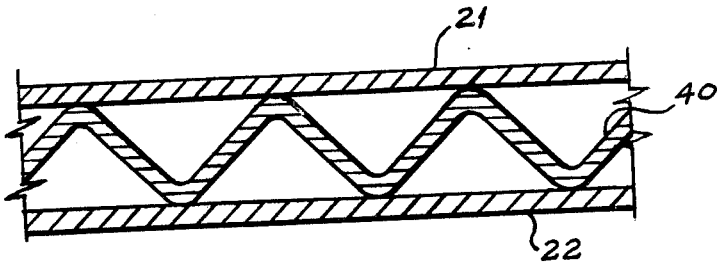
FIG. 7 is a schematic representation of alternate projections which can be used in the present invention.

Another embodiment of the present invention is shown in FIG. 7. In FIG. 7 neither outer shell 21 nor inner shell 22 has projections. The projections have been replaced with rib 40, rib 40 being substantially sinusoidal in shape. Rib 40 can also be used in conjunction with the projections 25 described previously.

Figure 8:
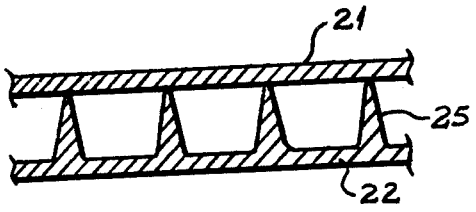
FIG. 8 and FIG. 9 are schematic representations of a portion of a cross-section of a helmet before and after impact, respectively, with an object.
Figure 9:
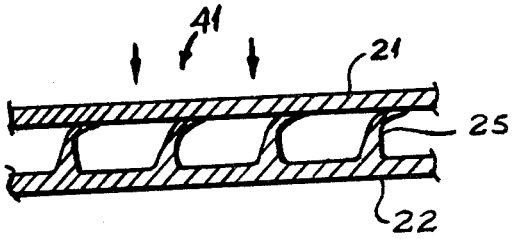

The effect of an impact is shown in FIG. 8 and FIG. 9, in which 22 is an inner shell and 21 is an outer shell. Under the influence of an impact, shown generally by arrows 41 in FIG. 9, outer shell 21 is forced towards inner shell 22. Projections 25 bend, or flex, under the compressive force generated, hereby becoming distorted from their original shape and absorbing some of the energy. Subsequently projections 25 return to substantially their original shape.

Figure 10:
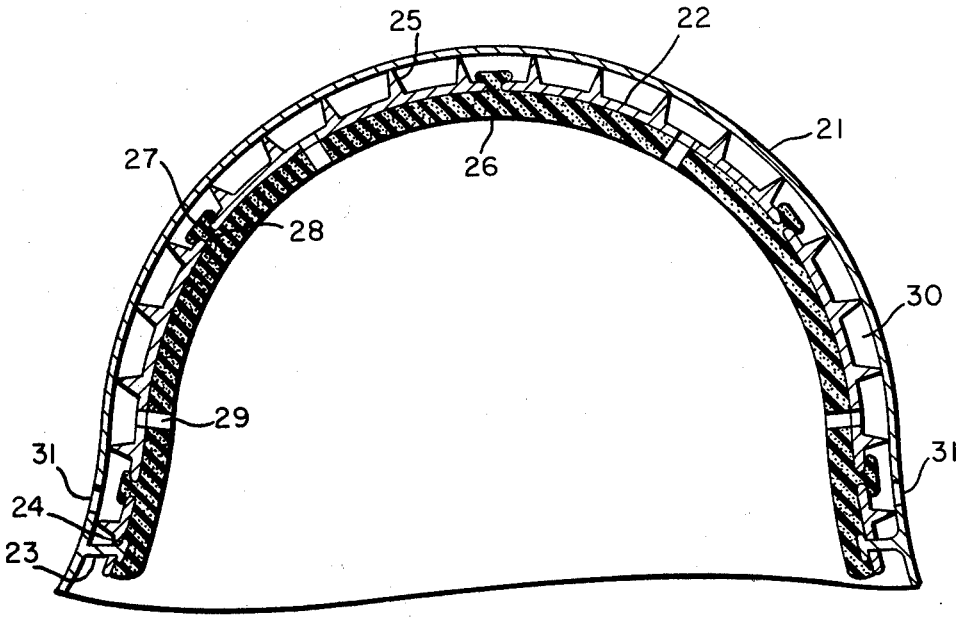
FIG. 10 is a schematic representation of another protective helmet of the invention having inner and outer shells.

FIG. 10 shows a protective helmet having an outer shell 21 and an inner shell 22. In the embodiment shown, inner shell 22 is attached to outer shell 21 by means of snap projections 23 being pushed through snap orifices 24 in inner shell 22, snap orifices 24 being located at each end of inner shell 22. Snap projections 23 are shown to be integrally attached to outer shell 21. It will, however, be understood by those skilled in the art that various other means may be used to locate inner shell 22 within outer shell 21.

Inner shell 22 has a plurality of projections 25 on the surface of inner shell 22 facing outer shell 21. Projections 25 are integrally attached to inner shell 22 and extend so that the ends thereof contact or are juxtaposed to the inner surface of outer shell 21. As an alternative, projections 25 may be integrally attached to a base 33 (shown in FIG. 3), base 33 being either a part of the inner surface of outer shell 21 or it may be a separate base located in space 30 between outer shell 21 and inner shell 22 of FIG. 10. Projections 25, which are elongated and taper towards their free end, are adapted to flex when subjected to a compressive force and revert to essentially their original shape when relieved of the effects of such a force. Such projections are referred to herein as being substantially rigid. These projections are of the same type previously illustrated in FIGS. 3–9 for optional use in the protective helmets of FIGS. 1 and 2.

In the embodiment shown in FIG. 10 cushioning means 26, in the form of foam pads, are located on the inside, i.e. the side which would contact a users head, of inner shell 22. Cushioning means 26 are attached to inner shell 22 by means of snaps 27 inserted through orifices 28 in inner shell 22. Other means of attaching cushioning means 26 to inner shell 22 can be used, as will be understood by those skilled in the art. In the embodiment of FIG. 3, air vents 29 are shown to pass through cushioning means 26 and inner shell 22. Air vents 29 facilitate the circulation of air, for cooling, between the inside of the helmet and the space 30 between inner shell 22 and outer shell 21. External air vents 31 connecting to space 30 may be provided in outer shell 21.

Although not shown in FIG. 10 the protective helmet can have additional cushioning means e.g. elastic straps, located within the helmet for further absorption of energy. The helmet preferably has support means e.g. straps, adapted to position the helmet on a users head. The helmet may also have attachment means e.g. a chin strap, adapted to retain the helmet on the users head.

The protective helmet of FIG. 10 can have an outer shell 21 with an inner shell 22 juxtaposed to essentially the entire inner surface thereof. However in a preferred embodiment, especially for economics of construction of the helmet and to lighten the helmet, the inner shell 22 may be juxtaposed to only part of outer shell 21, such part being in particular at those parts of the helmet that protect especially vulnerable portions of the user's head e.g. forehead, temples and the like. Inner shell 22 may therefore be of an irregular shape, depending on which parts of the head it is particularly desirable to protect in the light of the intended end use of the helmet. For example in a construction helmet objects will tend to strike the helmet on the top whereas in a hockey helmet greater emphasis may be necessary on the sides, front and back of the helmet. Other cushioning e.g. foam pads, may be located at some or all of those parts where inner shell 22 is not present.

The protective helmets of the present invention can be fabricated from a variety of thermoplastic and thermoset polymers, the particular polymer depending on in particular the intended end-use of the helmet and the required properties of the helmet; thermoplastic polymers are preferably used to fabricate the projections. The outer and inner shells of the protective helmet can be fabricated from the same or different polymers, the location and type of projections used, and the properties thereof, being factors in the selection of the polymers for the shells. Examples of polymers are poly-α-olefins e.g. polypropylene, homopolymers of ethylene and copolymers of ethylene and other α-olefins e.g. butene-1 and vinyl acetate, and mixtures thereof; polyamides, especially polyhexamethylene adipamide and blends thereof with a compatible elastomeric or rubber material, polycarbonate, acrylonitrile/butadiene/styrene polymers; polyvinyl chloride; cellulose acetobutyrate; polybutylene terephthalate, polyoxymethylene polymers; polyester or epoxy polymers reinforced with glass or KEVLAR* aramid fibers, and the like. In preferred embodiments the outer shell is fabricated from a polyethylene, or a blend of polyethylenes, having a density of at least 0.950 and a melt index in the range 1 to 12, especially 4 to 6, melt index being measured by the method of ASTM D-1238 (Condition E), and the inner shell is fabricated from a similar polyethylene or a blend of 50–70%, by weight, of such a polyethylene and 30–50% by weight, of an ethylene/vinyl acetate copolymer having 15 to 20% of vinyl acetate comonomer. Preferably the polymer is selected so that injection moulding techniques may be used in the manufacture of the helmet.

Projections 36 shown in FIG. 5 and FIG. 6 can be obtained using injection moulding techniques. In injection moulding, ejector pins are used to facilitate removal of the injection moulded article from the mould. While relatively few pins are normally used in an injection moulding process, a plurality of ejector pins can be utilized to obtain projections 36. In order to do so, the ejector pin can be machined to the shape required to obtain protrusions 37 of projection 36. A plurality of ejector pins so machined can be used in the formation of a plurality of projections 36 on the article that is injection moulded.

The size and number of the projections of the helmet will depend on the particular thermoplastic material and on the required properties of the helmet. In embodiments the projections illustrated in FIG. 4 can have a height of 0.5–1.5 cm and a thickness of 0.050–0.150 cm, whereas the projections of FIG. 5 and FIG. 6 can have a height of 0.25–0.75 cm. Other embodiments are exemplified hereinafter.

The number of projections per unit area can vary depending on the location within the protective helmet and the desired properties of the helmet. In one embodiment the projections of FIG. 5 and FIG. 6 are aligned so that the centers of the projections are at the corners of squares. Additional projections can be placed at the centers of such squares. The diameter of the circles formed by the projections shown in FIG. 5 and FIG. 6 may be important in the location of the projections. Examples of such diameters are given hereinafter.

The present invention is further illustrated by the following examples.

EXAMPLE I

The procedure used to test helmets in this Example was that specified in Canadian Standards Association Standard Z 262.1–1975 "Hockey Helmets". In summary the procedure involves a Brinell impact test in which a birch striker block weighing 4.54 kg falls freely from a height of 61 cm to strike a test sample (helmet) located on a polyurethane headform. The force transmitted by the test sample is determined by means of the impression made in an aluminum bar of a Brinell penetrator assembly.

Using the above procedure a commercial hockey helmet was tested, the impact of the striker block being on the top of the helmet. The helmet had a polycarbonate shell of thickness of 0.25 cm and a polyurethane foam pad of a thickness of 1.76 cm at the top of the helmet. The force transmitted was 4.9 k Newtons. When the foam pad was removed and the shell alone was tested the force transmitted was 14.8 k Newtons.

Cushion pads, hereinafter referred to as pin cushions, having projections of the type shown in FIG. 6 and FIG. 7 were manufactured by injection moulding techniques. The polymer used was a blend of 67 parts of SCLAIR* 2907 polyethylene, an ethylene homopolymer of a density of 0.960 g/cm$^3$ and a melt index of 5, and 33 parts of ALATHON* 3170, an ethylene/vinyl acetate copolymer containing 18% by weight of vinyl acetate and having a melt index of 2.5 and a density of 0.940 g/cm$^3$. The pin cushions either had "long teeth" i.e. projections of a length of 0.475 cm and a thickness at their base of 0.1 cm, or "short teeth" i.e. projections of a length of 0.30 cm and a thickness at their base of 0.1 cm. In each case, the pin cushions were approximately 7.5 cm square with the projections aligned in rows and spaced apart at 1 cm centers. The diameter of the circle of projections was 0.6 cm. The thickness of the base of the pin cushion was 0.150 cm.

A pin cushion was placed in the center of the shell of the hockey helmet i.e. the shell without foam pads, referred to above and a pad of a foamed polyurethane of density of 0.115 was placed under the pin cushion thereby producing a construction of shell/pin cushion/-pad. The resultant construction was then tested and the results obtained were as follows:

| Run | Pin Cushion (type) | Pad Thickness (cm) | Force Transmitted (k Newtons) |
|---|---|---|---|
| 1 | long | — | 12.4 |
| 2 | long | 0.45 | 11.1 |
| 3 | long | 0.88 | 6.4 |
| 4 | long | 1.33 | 4.7 |
| 5 | long** | 0.45 | 0.1 |

**two pin cushions placed face-to-face were used

The above procedure was repeated with a commercially available hockey helmet manufactured by a different manufacturer. This commercial helmet also has a polycarbonate shell of a thickness of 0.25 cm but the foamed polyurethane pad was 1.4 cm in thickness. The force transmitted by the helmet was 4.8 k Newtons. When the shell alone was tested the force transmitted was 14.8 k Newtons.

This helmet was also tested using the pin cushions with and without polyurethane pads. The results obtained were as follows:

| Run | Pin Cushion (type) | Pad Thickness (cm) | Force Transmitted (k Newtons) |
|---|---|---|---|
| 6 | short | — | 10.3 |
| 7 | long | — | 9.4 |
| 8 | short | 0.45 | 6.7 |
| 9 | long | 0.45 | 6.4 |

-continued

| Run | Pin Cushion (type) | Pad Thickness (cm) | Force Transmitted (k Newtons) |
|---|---|---|---|
| 10 | short | 0.88 | 5.1 |
| 11 | long | 0.88 | 4.9 |
| 12 | long** | — | 7.7 |

**two pin cushions placed face-to-face were used.

EXAMPLE II

Pin cushions with short teeth, as described in Example I, were manufactured from (a) SCLAIR 2907 polyethylene, (b) a blend of SCLAIR 2907 polyethylene (2 parts) and ALATHON 3170 ethylene/vinyl acetate copolymer (1 part) and (c) a blend of SCLAIR 2907 polyethylene (1 part) and ALATHON 3170 copolymer (1 part). The pin cushions were tested by dropping a 4.54 kg weight having a rounded end from a height of 61 cm onto a test sample. The test sample had the following construction: a 0.63 cm thick steel plate measuring 15.24 cm by 15.24 cm/0.63 cm of a foamed material-/an area of pin cushion with the teeth facing away from the foamed material/ a 0.23 cm thick sheet of high density polyethylene. The force transmitted on impact of the weight was measured using a Brinell penetrator assembly.

In a series of experiments the total area of the pin cushions was varied, the center of the area of the pin cushions being at the point of impact of the weight.

The results obtained, expressed as force transmitted in k Newtons, were as follows:

| Area of Pin Cushion ($cm^2$) | Polymer | | |
|---|---|---|---|
| | SCLAIR 2907 | SCLAIR 2907/ ALATHON 3170 (1:1) | SCLAIR 2907/ Alathon 3170 (2:1) |
| 29 | 6.5 | 6.9 | 6.7 (8.9)* |
| 58 | 6.0 | 5.9 | 5.6 (8.0) |
| 87 | 5.8 | 6.0 | 5.5(7.8) |
| 131 | — | 6.9 | 6.8 (8.5) |

*the figures in brackets are comparative figures for test samples in which the foamed material was omitted.

The above procedure was repeated with pin cushions that had projections located between the rows in addition to the projections aligned in rows as in the pin cushions of Example I. The additional projections were identical to those of Example I except that the diameter of the circle of the addition projection was 0.5 cm.

The results obtained were as follows:

| Area of Pin Cushion ($cm^2$) | Polymer | | |
|---|---|---|---|
| | SCLAIR 2907 | SCLAIR 2907/ ALATHON 3170 (1:1) | SCLAIR 2907/ ALATHON 3170 (2:1) |
| 29 | 6.1 | 6.8 | 6.6 |
| 58 | 4.9 | 5.2 | 5.3 |
| 87 | 4.8 | 5.2 | 5.2 |
| 131 | 6.0 | 7.0 | — |

EXAMPLE III

A pin cushion with short teeth, as described in Example I, and manufactured from SCLAIR 2907 polyethylene was tested by dropping a 0.80 kg weight from a height of 127 cm onto a test sample. The test sample had the following construction: a 0.63 cm steel plate/a 0.23 cm sheet of high density polyethylene/pin cushion with projections facing the polyethylene sheet. The area of the pin cushion was 58 $cm^2$.

The test sample was tested at intervals of sixty seconds. The results obtained were, in sequence, as follows: 3.4, 3.5, 3.5, 3.2 and 3.6 k Newtons.

EXAMPLE IV

Pin cushions were manufactured from eigher SCLAIR 2907 or the blend of SCLAIR 2907/ALATHON 3170 referred to in Example I. The pin cushions were tested using the procedure of Example III.

The results were as follows:

| Run | Polymer | Pin Cushion (type) | Force Transmitted (k Newtons) |
|---|---|---|---|
| 1 | SCLAIR 2907 | short | 3.3 |
| 2 | SCLAIR 2907 | long | 3.2 |
| 3 | SCLAIR 2907/ ALATHON 3170 | short | 3.0 |
| 4 | SCLAIR 2907/ ALATHON 3170 | long | 3.0 |

EXAMPLE V

Pin cushions manufactured from a number of polymers were tested using the procedure of Example III. The results were as follows: (all samples had short teeth).

| Run | Polymer** | Force Transmitted (k Newtons) |
|---|---|---|
| 1 | A | 2.8* |
| 2 | B | 3.1 |
| 3 | C | 3.3 |
| 4 | D | 3.2 |
| 5 | E | 3.3 |
| 6 | F | 3.1 |

8 sample was warped

**A SCLAIR 2709 polyethylene, a polyethylene having a density of 0.950 and a melt index of 14.5
B SCLAIR 2507 polyethylene, a polyethylene having a density of 0.940 and a melt index of 5.0
C SCLAIR 2706 B polyethylene, a polyethylene having a density of 0.950 and a melt index of 0.65
D SCLAIR 8405 polyethylene, a polyethylene having a density of 0.937 and a melt index of 2.7
E SCLAIR 8107 polyethylene, a polyethylene having a density of 0.924 and a melt index of 5.1
F ALATHON 3170 ethylene/vinyl acetate copolymer.

I claim:

1. A protective helmet comprising:

(a) an outer shell;

(b) cushioning means located on the inside of said outer shell, said cushioning means including an inner shell spaced apart from the outer shell and being adapted to move relative to the outer shell;

(c) a plurality of projections located between the inner shell and the outer shell, each of said projections being integrally connected to a base selected from the group consisting of (1) the outer shell, (ii) the inner shell, and (iii) a base independent of said shells and which is located between said shells, said projections being elongated and substantially rigid and being adapted to flex when subjected to compressive force, the projections having free ends that contact or are juxtaposed to a shell.

2. A helmet of claim 1 wherein the inner and outer shells are of thermoplastic material independently selected from the group consisting of poly-α-olefins, polyamides, polycarbonate, acrylonitrile/butadiene/styrene polymers, polyvinyl chloride, cellulose acetobutyrate, polybutylene terephthalate, polyoxymethylene polymers and reinforced polyester polymers, said reinforced polymers being reinforced with glass with glass or aramid fibers.

3. A helmet of claim 2 in which the projections are integrally connected to a base selected from the group consisting of the outer shell and the inner shell and said outer shell and said inner shell and the projections thereon are each fabricated from polyethylene having a density of at least 0.950 and a melt index in the range 1–12.

4. A helmet of claim 2 in which the projections are integrally connected to the inner shell and said inner shell and the projections thereon are fabricated from a material selected from the group consisting of (a) polyethylene having a density of at least 0.950 and a melt index in the range 1–12 and (b) a blend of polyethylene of (a) with an ethylene/vinyl acetate copolymer having 15–20% by weight of vinyl acetate comonomer.

5. A helmet of claim 4 in which said melt index is in the range of 4–6.

6. A helmet of claim 1 in which the projections are integrally connected to the outer shell.

7. A helmet of claim 1 in which the projections are integrally connected to the inner shell.

8. A helmet of claim 1 in which the projections are integrally connected to a base independent of said shells and which is located between said shells.

* * * * *

UNITED STATES PATENT AND TRADEMARK OFFICE

CERTIFICATE OF CORRECTION

PATENT NO. : 4,307,471

DATED : December 29, 1981

INVENTOR(S) : Peter J. Lovell

It is certified that error appears in the above—identified patent and that said Letters Patent is hereby corrected as shown below:

Claim 2, column 9, line 6, "with glass", second instance, should be deleted.

Signed and Sealed this

*Fifteenth* Day of *June 1982*

[SEAL]

*Attest:*

GERALD J. MOSSINGHOFF

*Attesting Officer*

*Commissioner of Patents and Trademarks*